US006419392B1

(12) United States Patent
Baker

(10) Patent No.: US 6,419,392 B1
(45) Date of Patent: Jul. 16, 2002

(54) WEB OF STERILE BAGS FOR AUTOMATIC BAGGING EQUIPMENT

(75) Inventor: Tony D. Baker, Hudson, OH (US)

(73) Assignee: Advanced Poly-Packaging, Inc., Akron, OH (US)

( * ) Notice: Subject to any disclaimer, the term of this patent is extended or adjusted under 35 U.S.C. 154(b) by 0 days.

(21) Appl. No.: 09/704,953

(22) Filed: Nov. 2, 2000

(51) Int. Cl.[7] ..... B65D 30/02
(52) U.S. Cl. ..... 383/37; 383/66; 206/439
(58) Field of Search ..... 383/37, 66, 102; 206/438, 439

(56) References Cited

U.S. PATENT DOCUMENTS 3,254,828 A * 6/1966 Lerner ..... 383/37
4,306,656 A * 12/1981 Dahlem ..... 206/390
4,344,557 A * 8/1982 Lerner ..... 383/37
4,402,453 A * 9/1983 Regenstein, Jr. ..... 383/62 X
4,417,658 A * 11/1983 Gerdner et al. ..... 383/66 X
4,509,196 A * 4/1985 Sak et al. ..... 383/66 X
4,714,595 A * 12/1987 Anthony et al. ..... 206/439 X
4,726,970 A * 2/1988 Morrish et al. ..... 383/37 X
5,007,744 A * 4/1991 Scarberry et al. ..... 383/66 X
5,715,943 A * 2/1998 Thompson, Jr. ..... 206/439 X

* cited by examiner

*Primary Examiner*—Jes F. Pascua
(74) *Attorney, Agent, or Firm*—Renner, Kenner, Greive, Bobak, Taylor & Weber

(57) ABSTRACT

A web of serially positioned pre-opened sterile bags adapted for implementation with an automatic bagging machine is presented. The web of bags is defined by a polyester sheet selectively bonded to a paper backing sheet, with the bags being separable from each other by perforations. The webs of bags conducive for implementation with automated packaging equipment are devised by slitting columns of bags from an existing matrix and separating the bags within the columns from each other by means of perforations.

1 Claim, 2 Drawing Sheets

WEB OF STERILE BAGS FOR AUTOMATIC BAGGING EQUIPMENT

TECHNICAL FIELD

The invention herein resides in the art of packaging materials. More particularly, the invention relates to webs of bags conducive for implementation with automatic bagging equipment. Specifically, the invention relates to a web of serially interconnected sterile bags adapted for use in an automatic bagging machine, and the method for making such a web.

BACKGROUND ART

Presently, automatic bagging machines have become somewhat popular for use in bagging various articles and products. Specifically, such machines are configured to receive a continuous web of serially interconnected bags and to index the bags, one at a time, to a filling, sealing and separating station, where appropriate products may be placed into the bag, the bag sealed, and subsequently separated. Presently know systems utilize plastic film bags for the automated process.

Products being supplied to the medical industry are typically required to be packaged in sterile packaging. In that regard, the industry has come to know a particular matrix of bags consisting of a polyester sheet of film bonded in selected locations to a paper backing to define a matrix of sterile receptacles for receiving medical products. One such matrix is sold under the trade name TYVEK. As shown in the prior art presentation of FIGS. 1 and 2, a prior art matrix of sterile pre-opened bags is designated generally by the numeral 10. The matrix is contained upon a continuous sheet that includes a backing sheet of sterile paper or fabric, and a face sheet of appropriate plastic film, such as polyester. The face sheet 14 overlies and is immediately adjacent to the backing sheet 12. A plurality of uniformly positioned U or V shaped bonded regions 16 serve to define a plurality of uniformly positioned and aligned pockets or bags 18. The bonded regions 16 are typically achieved by thermal bonding by the application of heated dies or the like to the composite backing and face sheets 12, 14. Slits 20 are provided in the face sheet 14 bridging the tops of the parallel legs of U or V shaped bonded regions 16 to provide openings into the bags 18, so defined.

In using the prior art structures, the individual bags 18 were cut from the matrix sheet 10, filled, and heat or otherwise sealed across the top just beneath the slits 20. It can be readily appreciated that such a process is time consuming and labor intensive, There is a need in the art for sterile bags adapted for implementation with automatic bagging equipment to reduce the time, labor intensity and incident costs to such packaging operations.

DISCLOSURE OF INVENTION

In light of the foregoing, it is a first aspect of the invention to provide a web of sterile bags for automatic bagging equipment in which a web of sterile pre-opened bags is adapted for implementation with automatic bagging equipment.

Another aspect of the invention is the provision of a web of sterile bags for automatic bagging equipment obviating the time, labor intensity, and costs otherwise incident to packaging of materials in sterile bags.

Still a further aspect of the invention is the provision of a web of sterile bags for automated bagging equipment attained by separating a matrix of pre-opened sterile bags into a web of serially aligned bags, such bags being separated by perforations.

Another aspect of the invention is the provision of a method by which the prior art arrangement of pre-opened sterile bags which require manual separation, filling, and sealing can be obviated.

The foregoing and other aspects of the invention which will become apparent as the detailed description proceeds are achieved by a web of sterile bags for use with an automatic bagging machine, comprising: an elongated web of a plastic film face sheet bonded to a paper backing sheet to form a series of pockets; slits in said plastic film face sheet traversing a top end of each said pocket to define a pocket opening; and a series of perforations passing through said face and backing sheets and traversing said elongated web and separating each of said pockets from each other.

Other aspects of the invention are attained by a method for making a web of serially aligned pre-opened sterile bags for use in an automatic bagging machine, comprising: obtaining a web of a matrix of pre-opened sterile bags, said matrix defined by bags positioned in columns and rows; passing said web of a matrix of sterile bags through a perforator, said perforator imparting perforations to said matrix to separate rows of bags from each other while maintaining said matrix intact; passing said web of a matrix of sterile bags through a slitter, said slitter slitting said matrix to separate columns of bags from each and defining a separate independent web for each column; and winding said separate independent webs into rolls.

BRIEF DESCRIPTION OF THE DRAWINGS

For a complete understanding of the objects, techniques and structure of the invention reference should be made to the following detailed description and accompanying drawings wherein.

BEST MODE FOR CARRYING OUT THE INVENTION

Figure 1:
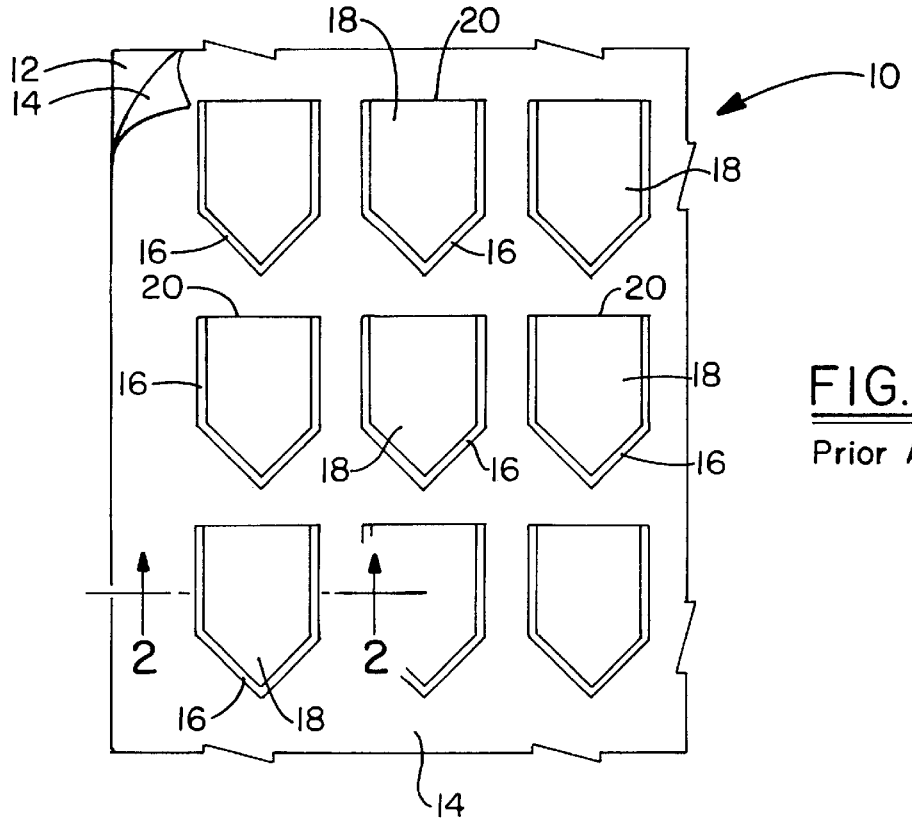
FIG.-1 Prior Art
FIG. 1 is a top plan view of a matrix of sterile bags according to the prior art.
Figure 2:
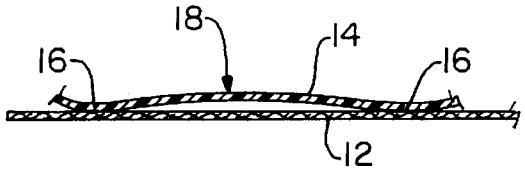
FIG.-2 Prior Art
FIG. 2 is a sectional view of FIG. 1 taken along the line 2—2.
Figure 3:
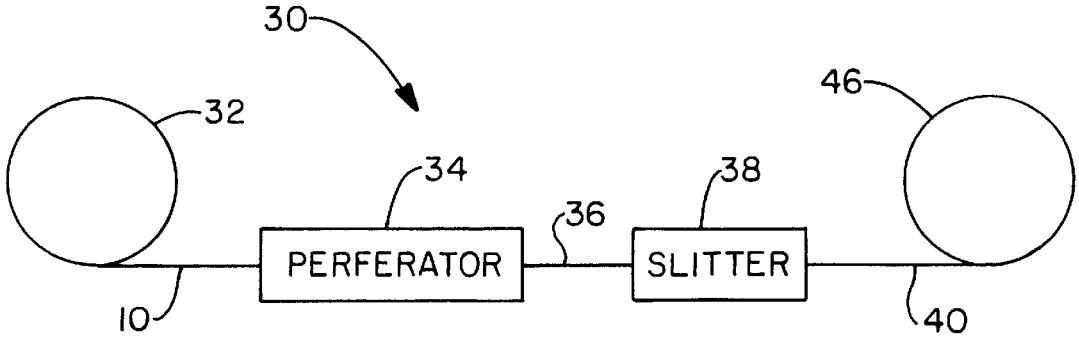
FIG. 3 is an illustrative view of the apparatus and equipment necessary for performing the process of the invention.
Figure 4:
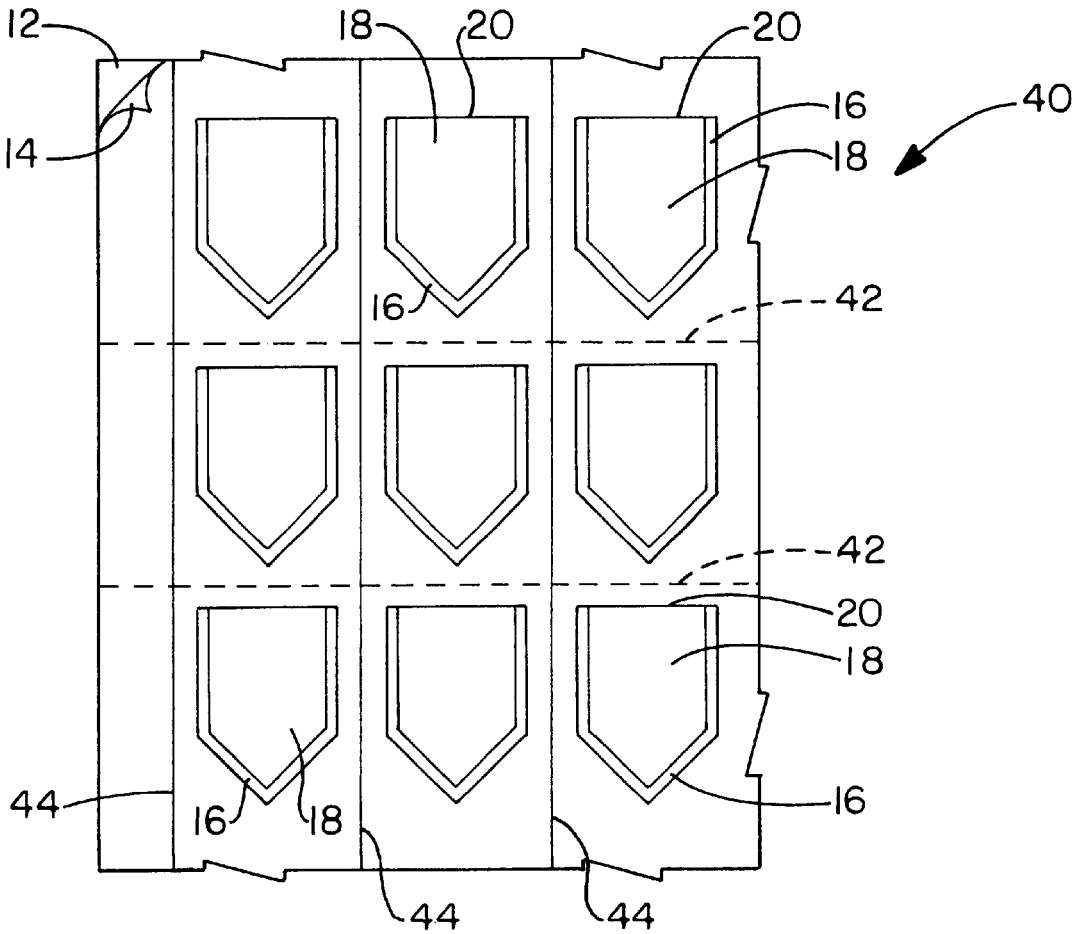
FIG. 4 is a top plan view of the matrix of FIG. 1 undergoing the process of FIG. 3.

With an appreciation of the prior art as presented above regarding FIGS. 1 and 2, an appreciation of the product and process of the invention can be obtained by reference to FIGS. 3 and 4. As shown in FIG. 3, the apparatus for performing the process to convert the matrix of the prior art depicted in FIG. 1 to a suitable form for implemtation with automatic bagging equipment is designated generally by the numeral 30. As shown, a roll 32 of the matrix of pre-opened bags 10 is fed to a perforator 34, where the perforations 42 (shown in FIG. 4) are imparted. The resulting perforated web 36 is then passed to a slitter 38, where rotary slitting knifes longitudinally slit the matrix 10 into a plurality of uniform webs between the slits 44. The resultant webs 40 are then retrieved upon a take-up roll or rolls 46.

It will be appreciated from the process that the rows of bags 18 in the matrix 10 are separated from each other by the perforations 42, while the matrix remains intact. After being subjected to the slitter 38, the slits 44 trim the edges of the matrix and then separate the columns of the bags 18 of the matrix 10 into separately defined webs. Accordingly, the matrix 10 is divided into a plurality of individual webs of pre-opened sterile bags serially connected to each other and adapted for separation from each other by the perforations 42. Each of the individual webs is particularly adapted for implementation with an automatic bagging machine in which the bags 1 8 are serially indexed to a position where they are loaded through the opening of the slits 20, sealed therebeneath by means of a heated platen or bar, and subsequently separated from each other by means of the perforation 42.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the scope and breadth of the invention reference should be made to the following claims.

What is claimed is:

1. A web of sterile bags for use with an automatic bagging machine, comprising;

an elongated web of a plastic film face sheet bonded to a sterile paper backing sheet to form a single column of a series of pockets;

slits in said plastic film face sheet traversing a top end of each said pocket to define a pocket opening;

a series of perforations passing through said face and backing sheets and traversing said elongated web and separating each of said pockets in a column from each other; and wherein said face and backing sheets are bonded together along a continuous path, said continuous path being open ended, said slits in said plastic film traversing said open end.

* * * * *